United States Patent [19]

Hubbard

[11] 4,212,219

[45] Jul. 15, 1980

[54] HARMONICA STAND

[76] Inventor: Dana L. Hubbard, 11 Leafwood Circle, San Rafael, Calif. 94901

[21] Appl. No.: 55,288

[22] Filed: Jul. 6, 1979

[51] Int. Cl.[2] ..... G10D 7/12

[52] U.S. Cl. ..... 84/1.06; 84/1.04; 84/DIG. 14; 84/379

[58] Field of Search ..... 84/1.04, 1.06, 379, 84/DIG. 14

[56] References Cited

U.S. PATENT DOCUMENTS

| | | | |
|---|---|---|---|
| 2,772,593 | 12/1956 | Zielinski | 84/DIG. 14 |
| 2,945,408 | 7/1960 | Terlinde | 84/DIG. 14 |
| 3,818,792 | 6/1974 | Gerbetz | 84/379 |

*Primary Examiner*—Gene Z. Rubinson
*Assistant Examiner*—Forester W. Isen
*Attorney, Agent, or Firm*—Melvin R. Stidham

[57] ABSTRACT

A holder for a harmonica comprising a pole mounted on a floor stand, a harmonica seat removably secured to the top of the pole and a pressure bar to releasably clamp a harmonica against the seat. A wind shield extends behind and above the seat to prevent respiratory sounds from reaching a microphone positioned immediately behind and below the wind shield, but an opening in the wind shield aligned with the harmonica enables the pickup of harmonica tones. A flexible screen extends between the pressure bar and the upper portion of the wind shield to block nasal respiratory sounds.

5 Claims, 3 Drawing Figures

HARMONICA STAND

BACKGROUND OF THE INVENTION

There are currently available holders for harmonicas which enable the musician to play the harmonica without requiring use of his hands free so that he may accompany the harmonica rendition with a piano, guitar or other hand-operated instrument. However, such devices are ordinarily suspended from around the musician's neck impeding his movements on the stage. Moreover, such devices generally do not make provision for microphone amplification of the harmonica tones.

OBJECTS OF THE INVENTION

It is an object of this invention to provide a holder for a harmonica with a microphone associated therewith.

It is a further object of this invention to provide a holder for a harmonica and microphone with means to prevent sound distoration, which might result from blowing into the microphone.

Other objects and advantages of this invention will become apparent from the description to follow, particularly when read in conjunction with the accompanying drawing.

SUMMARY OF THE INVENTION

In carrying out this invention, I provide a floor stand supporting an upright pole which, at the upper end is angled forward. A base plate or seat for a harmonica is releasable mounted at the top of the pole or rod, and a spring-biased pressure bar clamps the harmonica in place on the seat. A microphone also carried on the pole is disposed immediately behind and below the harmonica.

A wind shield of plastic or the like is disposed between the harmonica and microphone with a small opening aligned with the harmonica to enable passage of tones produced thereby. The wind shield extends upward from the harmonica and a flexible screen extending between it and the pressure bar also blocks the passage of nasal respiratory sounds for greater fidelity. An arm extending laterally from a pole can support a second microphone for separate vocal amplification.

DESCRIPTION OF A PREFERRED EMBODIMENT

Figure 1:
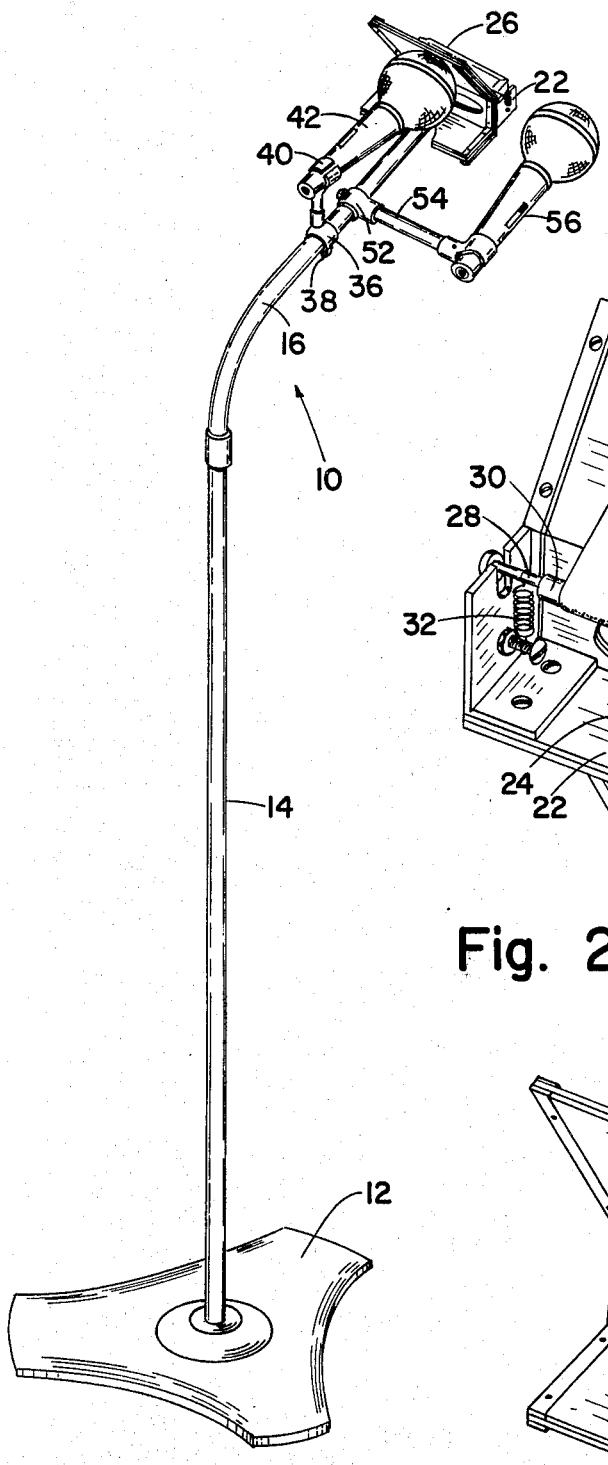
FIG. 1 is a view in perspective of the microphone-harmonica stand embodying features of this invention.
Figure 2:
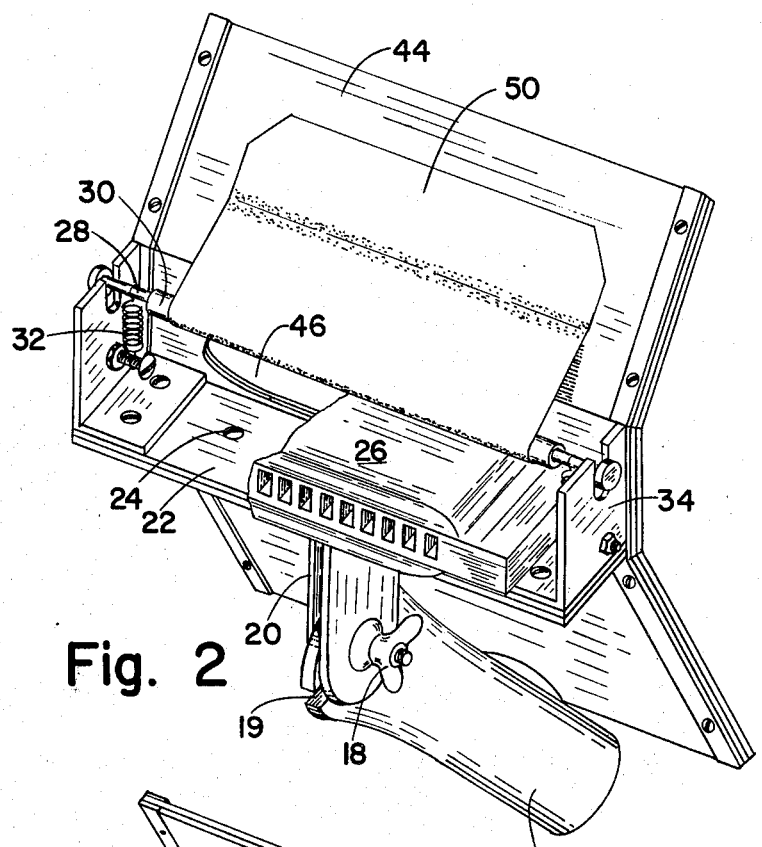
FIG. 2 is a partial view in perspective showing the harmonica mounting.
Figure 3:
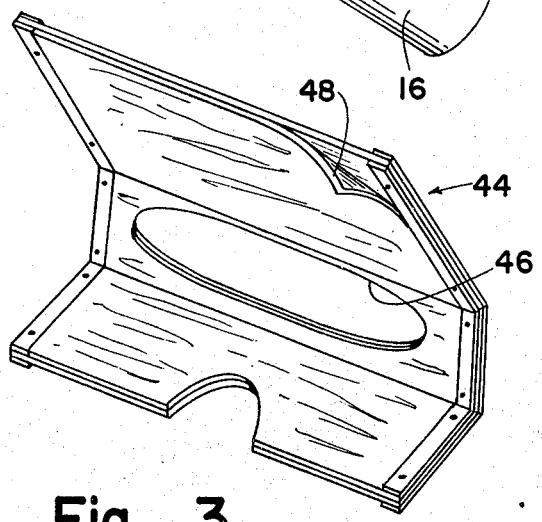
FIG. 3 is a view in perspective from the rear of the wind shield associated with the harmonica stands.

Referring now to the drawing with greater particularity, the microphone-harmonica stand 10 of this invention includes a base 12 of sufficient size and weight to insure stability, and a pole or rod 14 which extends upwardly from the base 12 and then angles forwardly at 16. Releasably secured on the end of the rod 16 as by means of a wing nut 18 is a mounting bracket 20 to which a harmonica base or seat 22 is secured as by means of round head screws 24. A musician may have a number of harmonicas clamped in seats 22, as shown, and the wing nut 18 enables rapid replacement by reason of the slot 19.

The round head screws 24, besides securing the harmonica base 22, actually support the harmonica 26 to greatly limit the amount of surface engagement with the base plate 22 to almost point engagement. This minimizes the vibration transmitted therefrom. A pressure bar 28, preferably with a resilient platen 30 thereon is spring biased at 32 in side plates 34 to clamp a harmonica 26 firmly in place against the support screws 24.

As best shown in FIG. 1, a mounting sleeve 36 slidably carried on the rod 16 and is releasably secured in any selected position on the rod 16 by screw means 38. The mounting sleeve 36 carries a microphone clip 40 to position a microphone 42 as close as possible to a harmonica 26 carried on the seat 22.

Interposed between the microphone and the harmonica 26 is a windshield 44 of any suitable material, such as Plexiglas or other suitable plastic. The shield 44 prevents the musician from blowing against the microphone 42, while tones from the harmonica emanate through an opening 46 in the shield. Preferably, the back surface of the windshield 44 facing the microphone 42 is "softened" with a coating of a sound absorbent material 48, such as leather. In addition, a shield of flexible material 50 is adhered to the windshield 44 and to the pressure bar platen 30 to prevent passage of nasal respiratory sounds through the opening 46 to the microphone 42.

Also if desired, a second mounting ring 52 is adjustably carried on the pole 16 and carries a laterally extending arm 54 to carry a second microphone 56 for the separate amplification of vocal sounds.

While this invention has been described in conjunction with a preferred embodiment thereof, it is obvious that modification and changes therein may be made by those skilled in the art without departing from the spirit and scope of this invention, defined by the claims appended hereto.

Having described my invention I claim:

1. The harmonica holder comprising:

means comprising a rigid upright pole adapted to be supported on a horizontal surface;

a harmonica support seat mounted on the end of said pole;

a spring-biased pressure bar adapted to clamp a harmonica in place on said support seat;

a first microphone holder;

means for releaseably securing said first microphone holder in a selected position along said pole; and a wind shield interposed between said harmonica support and said first microphone holder.

2. The harmonica holder defined by claim 1 including:

an opening in said wind shield aligned with a harmonica on said support seat.

3. The harmonica holder defined by claim 2 including:

a flexible screen extending between said wind shield and said pressure bar to shield a microphone on said first holder from nasal breath.

4. The harmonica holder defined by claim 1 including:

a support base carrying said pole and adapted to be supported on a horizontal surface.

5. The harmonica holder defined by claim 1 including:

a second microphone holder on said rod a lateral arm carrying said second holder to position a microphone carried therein laterally of said windshield means for releasably securing said arm in a selected position along said pole.

* * * * *